United States Patent [19]

Hansen

[11] 4,100,748

[45] Jul. 18, 1978

[54] MINE ROOF OR ROCK BOLT EXPANSION ANCHOR OF THE BAIL TYPE

[75] Inventor: Roger M. Hansen, Birmingham, Ala.

[73] Assignee: Stratabolt Corporation, Pelham, Ala.

[21] Appl. No.: 760,452

[22] Filed: Jan. 7, 1977

[51] Int. Cl.[2] ..... E21D 21/00; F16B 13/04

[52] U.S. Cl. ..... 61/45 B; 85/75

[58] Field of Search ..... 85/72, 75, 85, 78, 61, 85/77, 63, 76; 52/698, 704; 61/45 B

[56] References Cited

U.S. PATENT DOCUMENTS

| | | | |
|---|---|---|---|
| 406,565 | 7/1889 | Church | 85/75 |
| 1,352,494 | 9/1920 | Zifferer | 85/72 |
| 1,567,687 | 12/1925 | Tomkinson | 85/85 |
| 1,650,957 | 11/1927 | Ogden et al. | 85/75 |
| 3,969,976 | 7/1976 | Amico | 85/85 X |

*Primary Examiner*—Dennis L. Taylor

*Attorney, Agent, or Firm*—Mason, Fenwick & Lawrence

[57] ABSTRACT

A bail type expansion anchor for mine roofs and the like including a threaded bolt, and expander cone nut, and an expansible shell assembled together, with the shell formed from an integral blank of sheet metal having a pair of initially flat rectangular leaves bent to semi-cylindrical configuration with side edges thereof in abutment with each other to define a complete cylinder and having a bail strap of U-shaped configuration extending upwardly from the leaves and along side the cone nut. The bolt is threaded through the cone nut with the cone nut extending between the leaves of the shell, and the bail portion of the shell includes a circular top portion having a pop-out center having an interrupted circular periphery of slightly larger diameter than the bolt aligned with the bolt and connected to the remainder of the bail by frangible uncut attachment sections, designed to be broken out from the bail upon predetermined rotation of the bolt and form an aperture for passage of the bolt therethrough.

15 Claims, 8 Drawing Figures

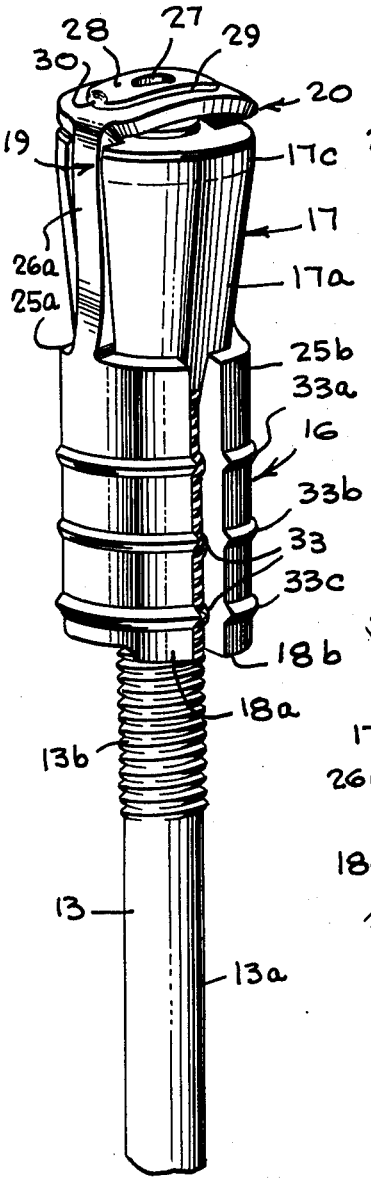
Fig-1
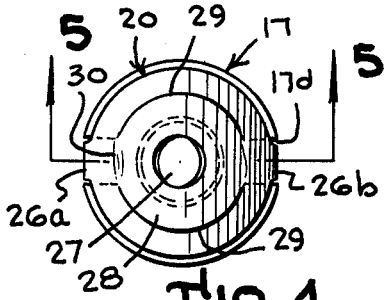
Fig-4
Fig-2
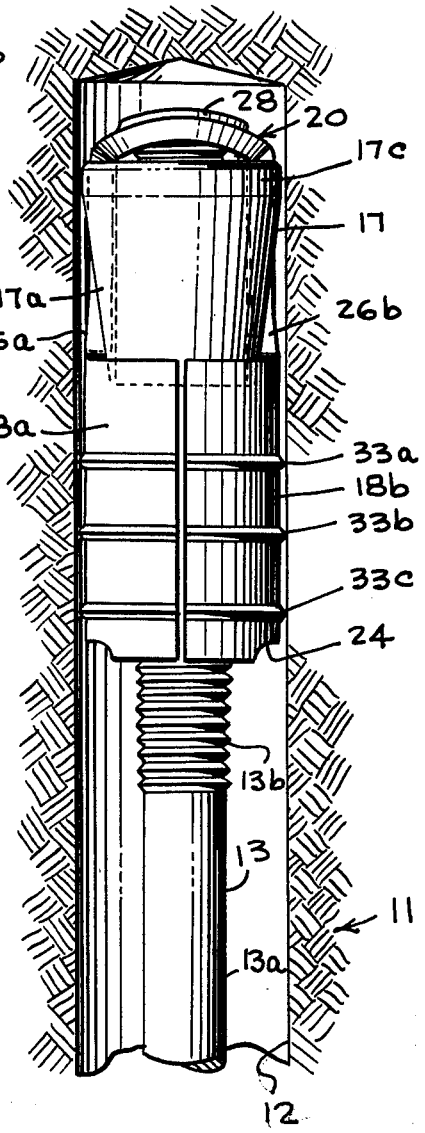
Fig-3
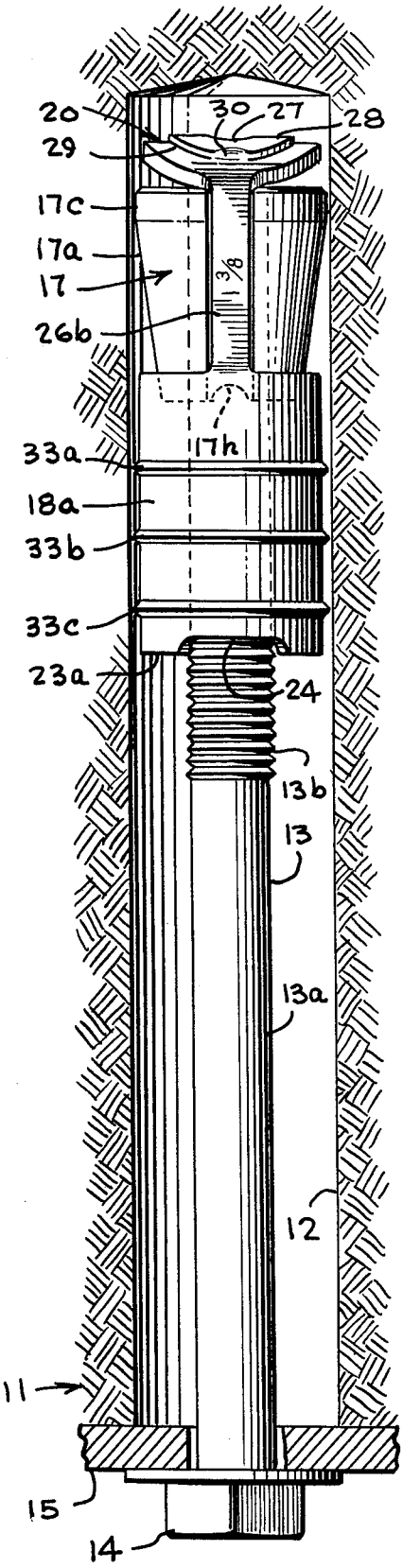

MINE ROOF OR ROCK BOLT EXPANSION ANCHOR OF THE BAIL TYPE

BACKGROUND AND OBJECTS OF THE INVENTION

The present invention relates in general to mine roof or rock bolt expansion anchors, and more particularly to an improved mine roof or rock bolt expansion anchor provided with means for quickly initially expanding the same in a mine roof bore hole to achieve initial anchorage for further manipulation to properly anchor it in place, and wherein the anchor is formed with a shell and bail composed of a uniform thickness of one piece of metal activated by a cone nut threaded onto a bolt to expand the shell into contact with the rock of the bore hole wall.

Roof suspension bolts or, as properly called, mine roof bolts, are now widely used. In the use of these bolts, holes are drilled upwardly into the mine roof or ceiling or into the overhanging rock mass, in a mine or similar excavation, and supporting bolts, designed to be secured in the bore holes to exert compressive force against the roof or to be directed through supporting plates or bars engaged with the roof or ceiling, are inserted in the holes and anchored therein for securely supporting the portions of the mine roof or ceiling near the bolts. The anchoring of the bolts is effected by employing an expansion anchor, inserted into the roof bores and through which the bolts are threaded. Means are included in these expansion anchors which are effective upon threading of the bolts inwardly to a predetermined extent to expand the shell portion of the anchors and cause them to firmly grip the wall portions of the bolt receiving bores. It is the purpose of the present invention to provide a novel form for such a mine roof or rock bolt expansion anchor which can be easily and economically manufactured, and which is subject to being inserted into a receiving bore formed in the rock ceiling or roof with great facility and capable of very securely anchoring a bolt threaded therethrough.

Such mine roof bolts as previously known usually consist of a long bolt provided with a multi-part permanent anchoring means on one end of the bolt to be expanded into secure retaining engaement with the side walls of the upper portion of a hole drilled in the roof of a deep mine, rock or other excavation. The anchoring means of conventional mine roof bolts presently in use are expandable, usually by manually driving the bolt with an appropriate bolt rotating tool. A problem involved in the installation of conventional mine roof bolts resides in the fact that such bolts are inserted in a substantially vertical hole in the roof or ceiling of a mine passageway, and many mine roof bolts do not have provision for quickly achieving initial expansion to temporarily restrain the bolt in place, after it has been inserted to its full extent in the drilled hole in the mine roof, and consequently, difficulty is encountered in holding the bolt temporarily in the hole while sufficient torque is applied to the bolt to expand the anchor to permanent anchoring condition. It is rather difficult and requires a great deal of care on the part of a laborer to manually hold the bolt in place during the period required to manipulate an appropriate tool to expand the expandable anchoring means so that it reliably retains itself in place in the hole.

An object of the present invention, therefore, is the provision of a novel form of mine roof or rock bolt expansion anchor of the bail type which can be easily and economically manufactured, which is convenient to operate, and which is capable of providing highly reliable anchoring of a bolt in a hole formed in a mine roof or rock ceiling or the like.

Another object of the present invention is the provision of a novel expansion bolt anchor of the bail type for mine roofs or similar installations formed so that the anchor will expand at a more rapid rate during initial turning of the bolt after the unit is placed within the bore hole and thereby achieve fast initial anchorage and which then expands at a slower rate upon further turning of the bolt, facilitating installation of the expansion anchor and providing highly reliable anchorage capacity.

Another object of the present invention is the provision of a novel expansion bolt anchor for mine roofs or ceilings and like installations, having high total anchorage capacity, wherein the anchor shell is designed with two opposing leaves permitting utilization of raw material which can be conveniently purchased in coil form, minimizing the cost of shearing of the raw material and the cost of handling the raw material when compared to the use of individual strips, thereby offering a most economical method for production of the unit without welds or mechanical attachment of a bail to the shell which might break off or distort in production.

Another object of the present invention is the provision of a novel expansion bolt anchor for mine roofs or ceilings and the like to be inserted in bore holes formed in the rock or roof formation, wherein a cone nut is provided to be threaded on the bolt to be anchored in the bore hole and drawn between opposite substantially semi-cylindrical leaves of an expandable shell formed initially as a one piece blank from a flat coil of metal raw material with the two leaves of the shell interconnected by a bail having a circular top which is slightly cupped in manufacture and includes a pop-out portion which is designed to break away under a specified load when the end of the bolt is driven against the pop-out portion with sufficient load during advancement of the bolt to fix the bolt anchoring assembly in the bore hole.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a perspective view of a mine roof or rock bolt expansion anchor assembly constructed in accordance with the present invention;

FIG. 2 is a longitudinal sectional view through a mine ceiling bore showing the bolt expansion anchor assembly in position for being anchored in the bore by turning of the anchor bolt, the bolt expansion anchor assembly being shown in side elevation;

FIG. 3 is an elevation view of the bolt expansion anchor assembly, viewed from a position circumferentially spaced 90° from the elevation of FIG. 2;

FIG. 4 is a top plan view of the expansion anchor assembly;

DETAILED DESCRIPTION OF A PREFERRED EMBODIMENT

Figure 5:
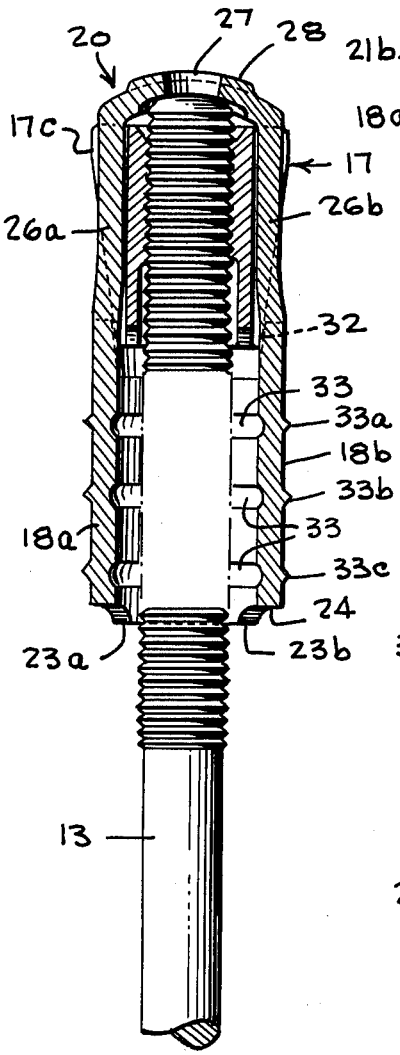
FIG. 5 is a vertical section view taken along the line 5—5 of FIG. 4.

Referring to the drawings, wherein like reference characters designate corresponding parts throughout the several figures, the bolt expansion anchor assembly of the present invention, indicated generally by the reference character 10, is illustrated in FIG. 2 in position in a section of a mine roof ceiling, indicated at 11, inserted in a drilled bore hole 12 in which the assembly is to be received and anchored. The anchoring assembly 10 is designed to serve as an anchor means to fix the bolt 13 in the bore hole, and in some applications, to extend through and seat its head 14 against a plate 15 which in turn supports the roof or ceiling, in one typical installation.

Figure 6:
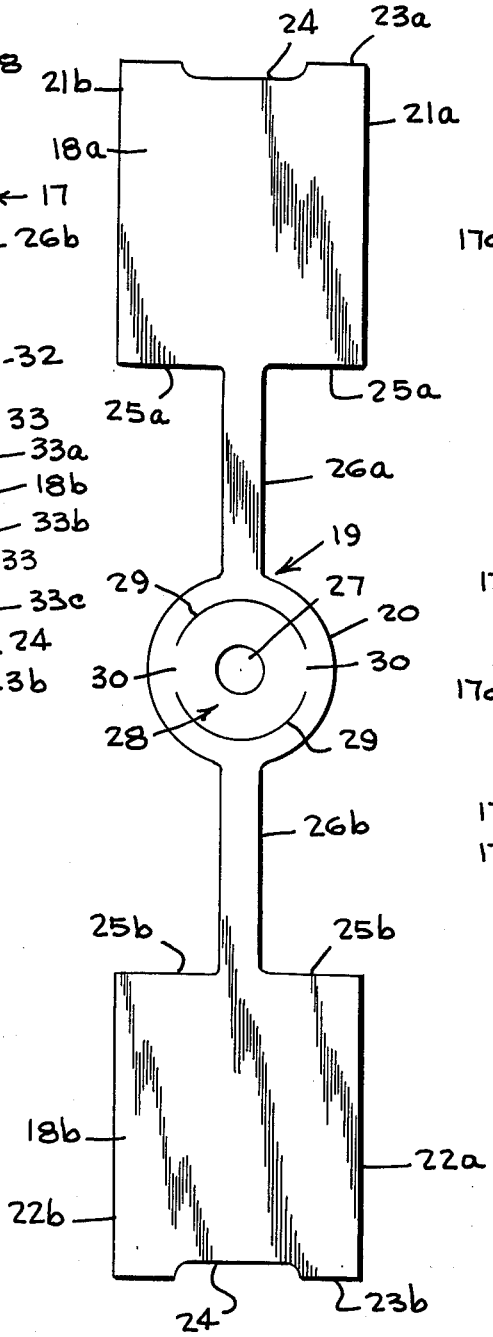
FIG. 6 is a plan view of the blank formed from the flat sheet material of coil stock to provide the sleeve.
Figure 8:
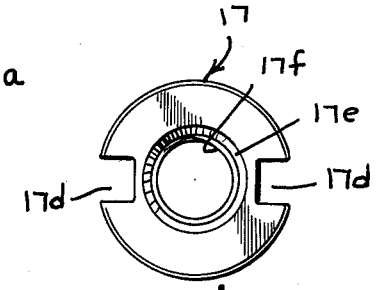
FIG. 8 is an end elevation view of the cone nut, viewed from the larger diameter end.
Figure 7:
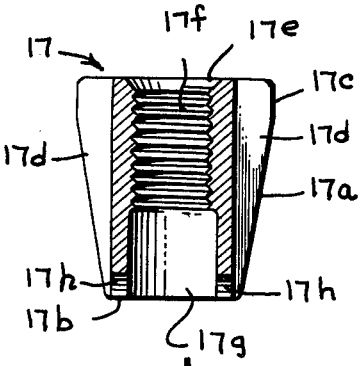
FIG. 7 is a vertical section view through the cone nut.

The improved bolt expansion anchor assembly 10 may be generally described as including an integral shell, indicated at 16, formed for example from a flat blank of steel or similar metal of the shape illustrated in FIG. 6 from material which can be supplied as coil stock, and includes a cone nut or expander plug 17, for example of forged steel or malleable cast iron, which, when the parts are completely shaped and properly assembled, is held within the shell 16 against inadvertent fallout, in a manner to be described hereinafter.

The bolt 13 has the usual square or non-round head, indicated at 14 and an elongated round shank **13*a* with threads 13*b* extending from the end portion over a major portion of its length. The cone nut 17 is of truncated conical configuration over most of its axial length, having a conically shaped wall or surface portion 17*a* progressively enlarging in diameter from the smaller end 17*b* to the larger diameter cylindrical shoulder portion 17*c* at the opposite end of the cone nut. The cone-shape surface portion 17*a* and shoulder portion 17*c* are interrupted at diametrically opposite regions by bail slots or grooves 17*d* extending the entire axial length of the cone nut 17 along longitudinal axes parallel to the cone nut center axis to receive legs or sides of a bail portion of the shell 16 as later described. The cone nut 17 is designed with a center bore shaped to provide a beveled entrance 17*e* to facilitate and guide entrance of a drill and tap during manufacture to form threads 17*f* along the midregion of the bore, and is provided also with adequate clearance and an upper bevel, in the region 17*g*, to facilitate assembly of the bolt and anchor unit while still maintaining sufficient thread length along the region 17*f* to develop maximum strength of the bolt during tension. The base of the cone nut 17 is cut out as indicated at 17*h* to provide a pilot for properly aligning the cone nut in relation to the bail and leaves of the shell 16** during manufacture.

The anchor shell 16 is formed basically of a pair of leaves **18*a*, 18*b* which are of half cylinder form in the final assembly interconnected by a bail generally indicated at 19 having a circular top 20. The shell and bail element forming the leaves 18*a*, 18*b* and the interconnecting bail 19 with its circular top portion 20 are composed of a uniform thickness of one piece of metal which is formed as a flat blank and permits economical production from common, inexpensive raw material which can be purchased in coil form. The two opposing leaves 18*a*, 18*b* are initially substantially rectangular in configuration, having straight parallel side edges 21*a*, 21*b* and 22*a*, 22*b* and having a transverse bottom edge 23*a*, 23*b* interrupted by an elongated inset or shallow recess 24. The top edges 25*a*, 25*b* of the leaves 18*a*, 18*b* form straight transverse shoulders which merge into the bail sides formed by narrow, straight legs 26*a*, 26*b* extending from the leaves to the enlarged circular top 20. The enlarged circular top 20 is provided with a small hole 27** which is used as a pilot hole during manufacturing and serves to keep the bolt centered as it turns in contact with the bail during operaton, as later described.

The circular top 20 of the bail structure also includes a pop-out center portion 28 formed by two substantially semi-circular cuts 29 concentric with the center of the hole 27 and the circular periphery of the circular top 20 but held in place until use by uncut or unsheared sections or interruptions 30 at diametrically opposite locations. The unsheared sections 30 of the circular top are designed to break under a specified load and permit the circular center portion 28 defined by the cuts 29 to pop out of the circular top 20 as the bolt is initially turned sufficiently to butt the end of the bolt against the pop-out portion 28 and apply sufficient force to break the unsheared portions 30, and provide a hole of sufficient diameter to give the advancing bolt adequate clearance to pass through the circular hole left when the pop-out center 28 breaks out, while leaving the annular rim of the circular top of the bail which remains with sufficient strength to prevent any misalignment of the two leaves of the shell as the cone nut continues to draw down and expand the shell. The circular top 20 of the bail is slightly cupped in manufacture to assume the curvature illustrated in FIG. 2. By virtue of this geometry, the pop-out portion 28 can be sheared in manufacture without the necessity of cutting an opening in the metal which would let dirt fall into the cone nut threads. In addition, the cupped geometry of the circular top 20 of the bail facilitates entry of the unit into the bore hole while the curved geometry of the pop-out section 28 provides a self-centering surface for contact with the top of the advancing bolt. The circular top 20 of the bail with no openings other than the small center pilot and guiding hole 27 which is blocked by the bolt end in the assembled condition of the unit ready for use, virtually fills the entire bore hole thereby preventing dirt and dust from falling into the cone nut and interferring with the internal threads. This results in more consistent bolt torque and therefore better control of the tension in the bolt as measured by the torque required for proper installation.

The thickness of the material used to form the shell making up the leaves **18*a*, 18*b* and the bail 19 with its circular top portion 20 is calculated as that maximum amount, given the diameter of the bore hole, which subtracted from the diameter of the cone nut or plug 17 in order to provide for the bail slots 17*d* in the cone nut for the bail legs 26*a*, 26*b*, would leave sufficient wall thickness between the bail slots 17*d*** of the cone nut and the internal threads thereof to prevent collapse of the cone nut under load. The performance of the anchor is dependent upon the total expansion capacity of the shell which in turn is determined by the maximum diameter of the cone nut, the thickness of the expansion shell, and the elevation of the striations which will be formed in the leaves of the shell as later described.

The two sides or legs **26*a*, 26*b* of the bail are designed of minimum width which permits, with the thickness and material used, adequate strength to hold the two leaves 18*a*, 18*b* of the shell in proper alignment throughout the process of insertion in the bore hole and expansion of the assembly. By virtue of keeping this width at a minimum, the bail slots 17***d* in the cone nut 17 are decreased to their minimum width, thereby increasing that portion of the circumference of the cone nut which is available for expanding the two leaves of the shell.

The two sides or legs 26*a*, 26*b* of the bail 19 offer a convenient place for the manufacturer to stamp the hole diameter and manufacturer's identification required by government specifications for roof and rock bolt anchorage devices. Since these bail sides or legs 26*a*, 26*b* are of one piece integral with the leaves 18*a*, 18*b* of the shell, these information stampings can be stamped during the forming process in an ecomonical manner. The entire bail 19, composed of the circular top 20 with its pop-out center section 28 and the two bail legs or sides 26*a*, 26*b*, by virtue of being integral with and composed of the same material as the two leaves 18*a*, 18*b* of the shell, offer the most economical method for production of the unit, since no welds or a mechanical attachment of the bail to the shell which might break off or distort in production or utilization are involved and facilitates minimizing cost of assembly for the expansion anchor unit.

The two leaves 18*a*, 18*b* of the anchor shell 16 are swaged in the region 32 transversely across the width of each leaf adjacent the shoulder or top edge portion 25*a*, 25*b* to provide a seat for the cone nut 17. By virtue of this swaged section 32, the bottom or minimal diameter of the smaller end 17*b* of the cone nut 17 can be increased, thereby decreasing the taper of the cone nut side 17*a* over a given length. Minimizing this taper decreases the effect of bleed-off or the tendency of the bolt and anchor assembly to lose tension over time. The swaged section 32 also increases the rate of initial expansion as the cone nut 17 draws down into the shell 16, permitting the anchor to take a rapid initial set with minimal movement of the unit within the bore hole and thereby minimal distrubance of the supporting rock comprising the bore hole wall. The length of the bail sides or legs 26*a*, 26*b* is designed as that minimum for economic construction and minimization of scrap which will still permit clearance for the cone nut 17, taking into consideration the swaged seat section 32 on the leaves 18*a*, 18*b* of the shell 16 which keeps the cone nut from misaligning prior to its engagement and starts the expansion of the shell as the cone nut 17 starts its downward travel.

During manufacture, the two leaves 18*a*, 18*b* of the shell 16 are coined at multiple points to raise striations or pointed deformations 33 on the exterior of the shell across the entire width of the two opposing leaves so that they will be aligned when the shell is formed into final shape. This coining operation provides the striations or external deformations 33 at the lowest possible cost of manufacture, and by virtue of the coining operation, the striations can be formed with no interruption across the entire width of the leaves, thereby permitting formation of substantially full 360° circular striations in the final assembly to bite into the bore hole wall. The width of the coined deformations on the interior surface of the leaves providing the striations 33 are designed as that minimum which will still permit full formation of the required striations 33 on the exterior of the shell while the cylindrical shoulder portion 17*c* of the cone nut is designed to be of sufficient axial length to bridge the coined deformations for the striations 33 at the interior surface of the leaves 18*a*, 18*b*, thereby maintaining smooth and continuous expansion of the anchor unit as the cone nut is drawn down into the shell. The first two striations 33*a*, 33*b* on the exterior of the shell 16 are designed with a geometry providing shear strength approximately equal to the average shear strength of the rock in the bore hole wall between the two striations 33*a*, 33*b*, to permit maximum utilization of the strength of the undisturbed rock in the bore hole wall, thereby increasing the total anchorage capacity of the unit. The final striation 33*c* is designed with a wider base dimension than those at 33*a* and 33*b*, and the slope of the striation 33*c* is decreased making this striation harder to press into the bore hole wall than the sharper striations at 33*a* and 33*b*. This increase in difficulty with which the striation 33*c* enters the bore hole wall offers increased resistance to the downward travel of the cone nut 17 thereby increasing the tension placed in the bolt during the final stages of tightening. The striations 33 are placed far enough apart to prevent crushing of the rock in the bore hole wall as the striations bite into the rock, thereby offering the maximum undisturbed rock for support of the anchor unit. The height of the striations 33 are designed to be the minimum which will offer adequate strength to bite into the bore hole wall and contribute to maximum anchorage capacity and that maximum height which when added to the thickness of the shell wall and formed into a cylinder will permit adequate clearance for the bolt and cone nut during both assembly and expansion of the unit.

In forming the complete bail type expansion anchor assembly ready for use, the two leaves 18*a*, 18*b* of the flat blank for the anchor shell 16 are first formed into half cylinders, and the shell blank is then bent about the central circular top portion 20 to deform the outer rim portion of the circular top to the slightly cupped or arched configuration illustrated in FIG. 2 and cause the center pop-out portion 28 to assume a corresponding arched configuration, and the bail legs or sides 26*a* and 26*b* are bent downwardly in the region where they join the circular top 20 to seat them in the bail slots 17*d* of the cone nut 17 and bring the side edges 21*a*, 21*b* of the half cylinder shaped leaves 18*a*, 18*b* into contact with each other. The sides or legs 26*a*, 26*b* of the bail 19 are bent inwardly at 26*c* to provide slightly inwardly converging lower leg portions in order to insure a tight closure of the mating edges of the half-cylindrical leaves while still allowing free downward travel of the tapered cone nut 17. By thus folding the shell to form the half cylinder shaped leaves 18*a*, 18*b* into a full cylinder shape, full 360° contact of the leaves of the shell with the bore hole wall are permitted, thereby increasing the total anchorage capacity of the assembly when compared to anchors of the types having three or four leaves.

In utilization, the bail type expansion anchor assembly comprising the assembled cone nut 17 and shell 16 is threaded loosely onto the ends of the mine roof or rock bolt 13 to thread the shank of the bolt 13 into the threaded portion 17f of the cone nut 17 and this assembly is then inserted into an appropriate diameter hole drilled in the roof of the mine or into the rock or other excavation in which the anchor is to be installed. The bolt 13 is then turned, advancing it through the threaded cone nut 17 until the threaded end of the bolt 13 contacts the circular top 20 of the bail 19. This contact prevents further movement of the shell 16 in relation to the bolt 13. Upon continued turning of the bolt 13, the cone nut 17 is drawn down into the shell 16, thereby expanding the anchor into contact with the rock of the bore hole wall. After initial anchorage is achieved, the center portion 28 of the bail 19 pops out at a predetermined load exerted by the top of the bolt. This then permits the shank of the bolt 13 to pass through the circular top 20 of the shell 16 as it is further tightened by rotating the head 14 in order to exert appropriate compressive force against the roof of the mine or excavation and place appropriate tension in the bolt in order to secure the rock mass. During this further tightening, the cone nut 17 continues to pull into and expand the shell 16 which is now prevented from moving by its initial anchorage in the bore hole wall.

What is claimed is:

1. An expansion anchor for mine roofs and the like comprising an expansible shell formed from an integral unitary blank of sheet metal having a pair of initially substantially rectangular leaves interconnected to each other at proximal ends thereof by a bail strap and free at the other ends thereof, said bail strap being bent to a U-shape and said leaves being bent to semi-cylindrical shape concentric with a bolt axis with their side edges in mutual abutment defining a generally cylindrical exterior for engagement with the walls of a mine ceiling bore, said bail strap having an enlarged circular top portion midway along its length and straight narrow leg portions extending in parallelism therefrom to said proximal ends of the leaves, an expander cone nut having an internally threaded bore and located in confined relation between said leaves and between said leg portions and having a generally frusto conical outer surface convergently tapering to a smaller diameter end interposed between said leaves to abut the leaves and spread them outwardly, a bolt threaded through the cone nut for moving the nut downwardly in the shell and bring progressively larger diameter portions of said outer surface against the leaves for spreading the leaves outwardly, said circular top portion of the bail having an pop-out center formed by a pair of substantially semicircular arcuate cuts therethrough defining a concentric circle interrupted by a pair of frangible uncut attachment sections, said pop-out center being of slightly larger diameter than the bolt and aligned with and adjacent the free end of the bolt to be abutted by the same and popped out upon predetermined rotation of the bolt and form an aperture for passage of the bolt through said top portion, and said circular top portion of said bail strap including said pop-out center and the remaining encircling portion being shaped in an upwardly convex cylindrical path having its axis of revolution passing through the bolt and with the uncut attachment sections arranged along a diametric axis paralleling the axis of revolution of said cylindrical path to facilitate centering of the bolt relative to the circular top portion upon engagement thereof.

2. An expansion anchor as defined in claim 1, wherein said cone nut has a diameter larger than the distance between the leg portion of said U-shaped bail strap at the larger end of the cone nut nearer said circular top portion and the tapered conical sides of the cone nut having rectilinear channel grooves in diametrically opposite portions thereof spanning the axial length of the cone nut parallel to its axis receiving said leg portions in slidable nesting relation therein to prevent rotation of the cone nut relative to the shell during rotation of the bolt.

3. An expansion anchor as defined in claim 2, wherein the inner confronting surfaces of said leaves along a path laterally spanning and adjacent the proximal end portions thereof are swaged to provide an inclined ramp surface defining a conical camming seat confronting and concentrically encircling the cone nut to insure proper alignment of the cone nut shell.

4. An expansion anchor as defined in claim 2, wherein the inner confronting surfaces of said leaves along a path laterally spanning and adjacent the proximal end portions thereof are swaged to provide an inclined ramp surface defining a conical camming seat confronting and concentrically encircling the cone nut to insure proper alignment of the cone nut and shell.

5. An expansion anchor as defined in claim 2, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration.

6. An expansion anchor as defined in claim 2, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration.

7. An expansion anchor as defined in claim 3, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration.

8. An expansion anchor as defined in claim 4, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration.

9. An expansion anchor as defined in claim 2, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration and the lowermost striation nearest the free end of the leaves having wider base dimension providing a less sharp striation than the remaining striations to increase force requirements for pressing the lowermost striation into the bore hole wall.

10. An expansion anchor as defined in claim 2, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration and the lowermost striation nearest the free end of the leaves having a wider base dimension providing a less sharp striation than the remaining striations to increase force requirements for pressing the lowermost striation into the bore hole wall.

11. An expansion anchor as defined in claim 3, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration and the lowermost striation nearest the free end of the leaves having a wider base dimension providing a less sharp striation than the remaining striations to increase force requirements for pressing the lowermost striation into the bore hole wall.

12. An expansion anchor for mine roofs and the like comprising an expansible shell formed from an integral unitary blank of sheet metal having a pair of initially substantially rectangular leaves interconnected to each other at proximal ends thereof by a bail strap and free at the other ends thereof, said bail strap being bent to a U-shape and said leaves being bent to semi-cylindrical shape concentric with a bolt axis with their side edges in mutual abutment defining a generally cylindrical exterior for engagement with the walls of a mine ceiling bore, said bail strap having an enlarged circular top portion midway along its length and straight narrow leg portions extending in parallelism therefrom to said proximal ends of the leaves, an expander cone nut having an internally threaded bore and located in confined relation between said leaves and between said leg portions and having a generally frusto conical outer surface convergently tapering to a smaller diameter end interposed between said leaves to abut the leaves and spread them outwardly, a bolt threaded through the cone nut for moving the nut downwardly in the shell and bring progressively larger diameter portions of said outer surface against the leaves for spreading the leaves outwardly, said circular top portion of the bail having a pop-out center formed by a pair of substantially semicircular arcuate cuts therethrough defining a concentric circle interrupted by a pair of frangible uncut attachment sections, said pop-out center being of slightly larger diameter than the bolt and aligned with and adjacent the free end of the bolt to be abutted by the same and popped out upon predetermined rotation of the bolt and form an aperture for passage of the bolt through said top portion.

13. An expansion anchor as defined in claim 12, wherein said cone nut has a diameter larger than the distance between the leg portion of said U-shaped bail strap at the larger end of the cone nut nearer said circular top portion and the tapered conical sides of the cone nut having rectilinear channel grooves in diametrically opposite portions thereof spanning the axial length of the cone nut parallel to its axis receiving said leg portions in slidable nesting relation therein to prevent rotation of the cone nut relative to the shell during rotation of the bolt.

14. An expansion anchor as defined in claim 13, wherein the inner confronting surfaces of said leaves along a path laterally spanning and adjacent the proximal end portions thereof are swaged to provide an inclined ramp surface defining a conical camming seat confronting and concentrically encircling the cone nut to insure proper alignment of the cone nut and shell.

15. An expansion anchor as defined in claim 13, wherein the shell leaves are coined outwardly along multiple circular paths along transverse planes of the cylinder formed by the leaves intermediate the upper and lower extremities thereof to provide outwardly pointing encircling striations on the shell exterior to press into the bore hole wall and increase the anchoring effect, the striations being of outwardly pointing triangular cross-sectional configuration and the lowermost striation nearest the free end of the leaves having a wider base dimension providing a less sharp striation than the remaining striations to increase force requirements for pressing the lowermost striation into the bore hole wall.

* * * * *